US006606971B2

(12) United States Patent
Abei

(10) Patent No.: US 6,606,971 B2
(45) Date of Patent: Aug. 19, 2003

(54) SMALL ENGINE FUEL INJECTION SYSTEM

(75) Inventor: Takashi Abei, Tokyo (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 10/092,054

(22) Filed: Mar. 5, 2002

(65) Prior Publication Data

US 2002/0124817 A1 Sep. 12, 2002

(30) Foreign Application Priority Data

Mar. 6, 2001 (JP) ..... 2001-061752

(51) Int. Cl.[7] ..... F02B 33/04
(52) U.S. Cl. ..... 123/73 C
(58) Field of Search ..... 123/73 C, 73 A, 123/179.11

(56) References Cited

PUBLICATIONS

John Deere Consumer Products—Two–Stroke Engine Technology Overview—Feb. 1999, pp. 1–7.
Deere Technology Breakthrough Reduces Small Engine Emissions, John Deere Website Feb. 4, 1999, pp. 1–2.
Basic Design of Two–Stroke Engines, Gordon P. Blair, Chapter 7, p. 333.

*Primary Examiner*—Tony M. Argenbright
*Assistant Examiner*—Katrina B. Harris
(74) *Attorney, Agent, or Firm*—Reising, Ethington, Barnes, Kisselle, P.C.

(57) ABSTRACT

A fuel injection system injects a rich mixture of fuel-and-air directly into a cylinder of a two cycle engine through an intake port for combustion. A charge forming device of the fuel injection system carries a primary air intake passage which flows air into the crankcase of the engine, and a rich fuel-and-air mixing passage which flows the majority of fuel into the cylinder, preferably via a tuned injector tube. To control air flow through the air intake passage and simultaneously control fuel flow into the fuel-and-air mixing passage, a rotary throttle valve rotateably and axially moveably traverses both passages. A mixture of fuel and oil is drawn into the air intake passage via a fuel bleed passage only during wide open throttle conditions for lubrication of moving parts and bearings contained within the crankcase.

12 Claims, 2 Drawing Sheets

SMALL ENGINE FUEL INJECTION SYSTEM

REFERENCE TO RELATED APPLICATION

Applicant claims priority of Japanese patent application, Ser. No. 2001-061752, filed Mar. 6, 2001.

FIELD OF THE INVENTION

This invention relates to a fuel injection system for small internal combustion engines and more particularly to a fuel injection system having a rotary throttle valve type charge forming device.

BACKGROUND OF THE INVENTION

Typically, carburetors have been used to supply a fuel and air mixture to both four-stroke and two-stroke small internal combustion engines. For many applications where small two-stroke engines are utilized such as handheld power chain saws, weed trimmers, leaf blowers, garden equipment and the like, carburetors with both a diaphragm fuel delivery pump and a diaphragm fuel metering system have been utilized. In operation, two-stroke engines utilizing these carburetors have a high level of hydrocarbon exhaust emissions which are detrimental to the environment and exceed and cannot meet the exhaust emission requirements imposed by the State of California and the emission requirements proposed by the Environmental Protection Agency of the United States Government and the governments of several other countries.

Due to the relatively low selling price of two-stroke small engines and particularly two-stroke engines for handheld power tools, it is not economically feasible to utilize electronic fuel injection systems such as those typically used for automotive vehicle applications. While various lower cost mechanical fuel injection systems have been proposed for two-stroke small engines, some have either failed to meet the California and proposed emission standards or are economically and/or technically unfeasible for commercial manufacture and sale for two-stroke small engine applications such as handheld power tools.

Fortunately, and incorporated herein by reference, U.S. Pat. No. 6,427,646 has provided a solution to economically reduce the level of hydrocarbon exhaust emissions from a small two-cycle engine by replacing the conventional carburetor with a charge forming device and a tuned injector tube which injects a rich mixture of fuel-and-air for combustion directly into the cylinder of a two-stroke engine, instead of into the crankcase as traditionally designed for lubrication then combustion purposes. The charge forming device of the above reference utilizes a series of butterfly valves to control fuel and air flow, however, this fuel injection system has yet to be applied to a charge forming device having a rotary type throttle valve. Furthermore, at high engine speeds or wide open throttle conditions, a mixture of fuel and lubricating oil, even with the fuel injection system technology, must still be drawn into the crankcase to lubricate bearings and moving parts, but without creating rough idle conditions or high emissions during low speed operation.

SUMMARY OF THE INVENTION

A fuel injection system injects a rich mixture of fuel-and-air for combustion directly into a cylinder of a two-cycle engine through an intake port for combustion. A charge forming device of the fuel injection system carries a primary air intake passage which flows air into the crankcase of the engine, and a rich fuel-and-air mixing passage which flows the majority of fuel into the cylinder, preferably via a tuned injector tube. To control air flow through the air intake passage and simultaneously control fuel flow into the fuel-and-air mixing passage, a rotary throttle valve rotateably and axially moveably traverses both passages. A mixture of fuel and oil is drawn into the air intake passage via a fuel bleed passage only during wide open throttle conditions for lubrication of engine moving parts and bearings contained within the crankcase.

A rotary member of the rotary throttle valve seats rotatably and axially movably in a valve chamber which communicates perpendicularly through the air intake passage. A throttle bore extends laterally though the rotary member and aligns with the air intake passage when the rotary throttle valve is rotated to a wide open throttle position, and partially mis-aligns to the air intake passage when the valve is rotated to an idle position. A needle controls fuel flow into the fuel-and-air mixing passage by projecting concentrically from the rotary member and axially into a fuel feed tube which delivers fuel from a fuel metering chamber into the fuel-and-air mixing passage. As the rotary member rotates to control air flow through the air intake passage, the rotary member and the needle move axially so that the end of the needle moves into and out of a fuel nozzle carried by the fuel feed tube to vary fuel flow into the fuel-and-air mixing passage.

Objects, features, and advantages of this invention include a rotary valve type fuel injection system for a two-stroke engine providing significantly decreased engine hydrocarbon exhaust emissions, significantly improved fuel economy, improved engine starting and idle running stability, improved ease, repeatability and stability for calibration and adjustment of the fuel-air ratio and flow rate of the fuel-and-air mixture, improved combustion stability, an extremely compact construction and arrangement, a relatively simple design, extremely low cost when mass produced, and is rugged, durable, reliable, requires little maintenance and adjustment in use, and in service has a long useful life.

BRIEF DESCRIPTION OF THE DRAWINGS

These and other objects, features and advantages of this invention will be apparent from the following detailed description, appended claims, and accompanying drawings in which:

DETAILED DESCRIPTION OF THE PREFERRED EMBODIMENT

Figure 1:
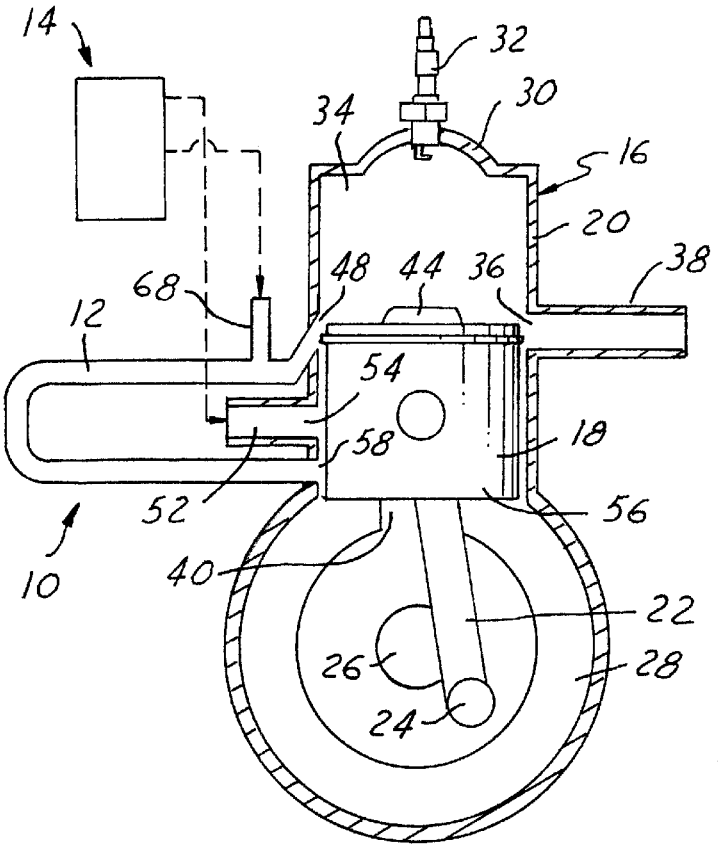
FIG. 1 is a semi-schematic side view partially in section of a fuel injection system with a charge forming device and an injector tube embodying this invention mounted on a two-stroke spark ignited internal combustion engine.

Referring in more detail to the drawings, FIG. 1 illustrates a fuel injection system 10 embodying this invention with a tuned injector tube 12 and a charge forming device 14 installed on a two-stroke spark ignition internal combustion small engine 16. Typically, the engine is powered by a hydrocarbon liquid fuel such as a mixture of gasoline and lubrication oil typically in a 50:1 ratio by volume. The two-stroke engine has a piston 18 received for reciprocation in a cylinder 20 and connected by a rod 22 to a throw 24 of a crankshaft 26 journalled by bearings for rotation in a crankcase 28. The piston and cylinder, in cooperation with a cylinder head 30 define a combustion chamber 34 in which a fuel and air mixture is compressed and ignited by a spark plug 32 to cause the piston to rotate the crankshaft in operation of the engine.

The engine has an exhaust port 36 and a connecting pipe 38 through which exhaust gases pass when the exhaust port is opened by the piston, air transfer passage 40 and corresponding cylinder port 44 through which intake air is supplied to the combustion chamber when the ports are opened by the piston near bottom dead center (BDC), and intake port 48 connected to one end of the injector tube 12 through which a rich fuel-and-air mixture is admitted to the combustion chamber through the port 48, while opened by the piston. Preferably, the intake port 48 and exhaust port 36 are diametrically opposed and the upper edge of the intake port 48 is slightly lower or further away from the cylinder head 30 than the upper edge of the exhaust port 36 so that the exhaust port opens slightly before the intake port. Primary air is admitted to the engine crankcase 28 from an intake passage 50 in the charge-forming device 14 through a connecting passage 52 and an air intake cylinder port 54 when opened by the skirt 56 of the piston. The other end of the injector tube 12 communicates with the crankcase through a port 58 when it is opened by the piston skirt 56.

Figure 3:
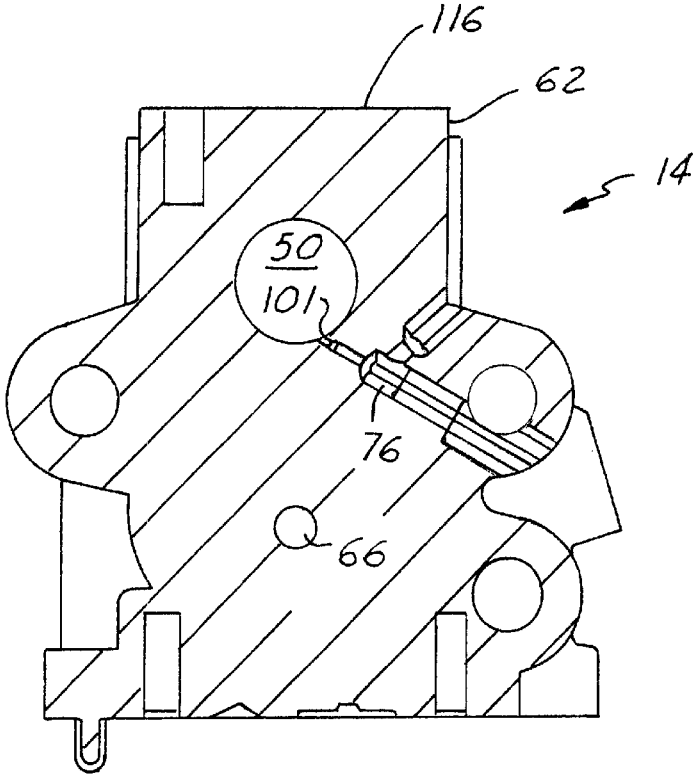
FIG. 3 is a sectional view of an upper body of the charge forming device taken generally on line 3—3 of FIG. 2.
Figure 2:
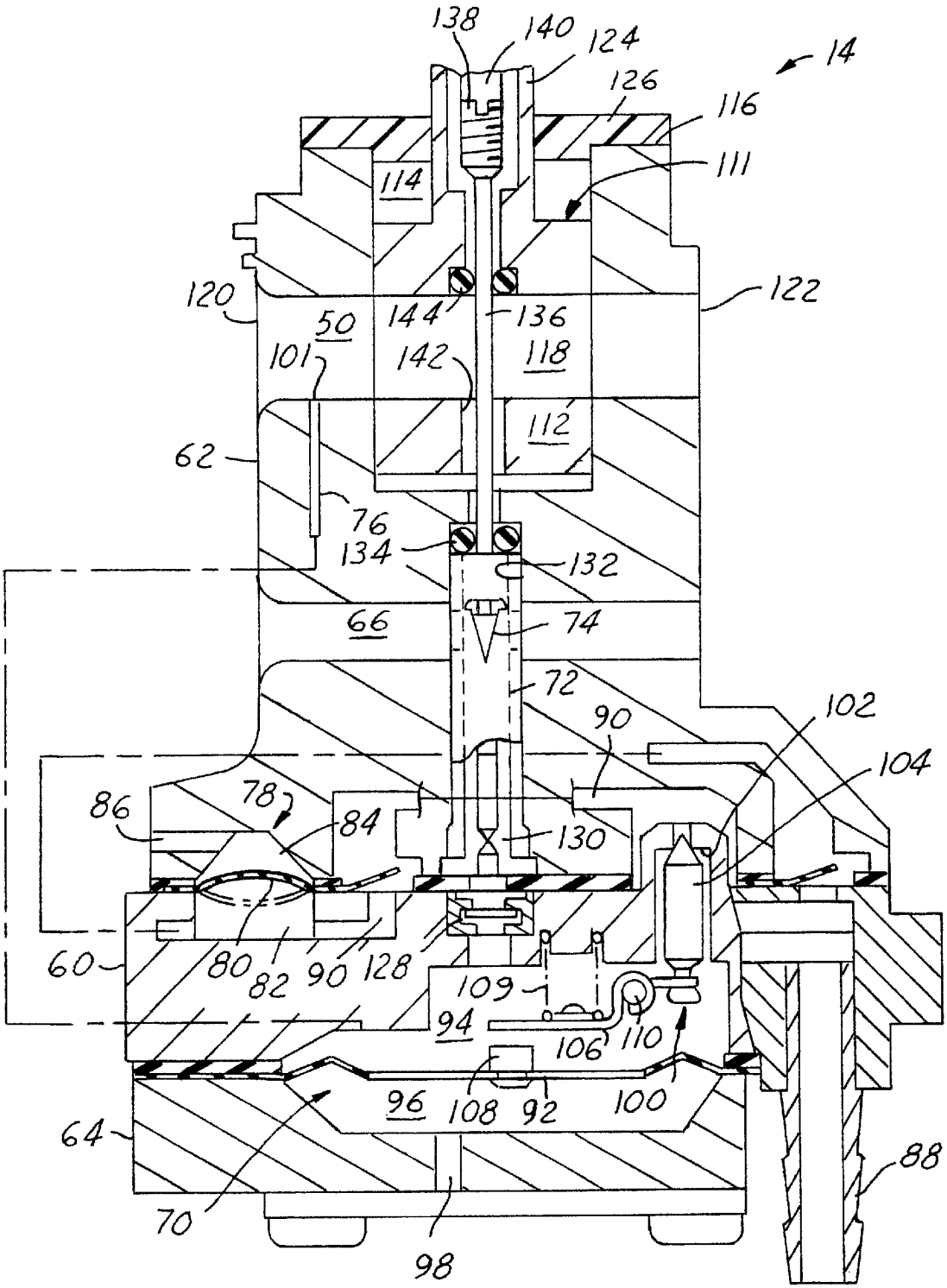
FIG. 2 is a sectional view of the charge forming device.

As shown in FIGS. 2–3, the charge forming device 14 has a body generally separated into three sections configured as an intermediate body 60 engaged between an upper body 62 and a bottom plate 64. An injector fuel-and-air mixing passage 66 extends through the upper body 62 and supplies a rich fuel and air mixture to the injector tube 12 through a connecting tube 68. A liquid hydrocarbon fuel such as gasoline is supplied from a fuel metering assembly 70, defined between the intermediate body 60 and the bottom plate 64, to the injector fuel-and-air mixing passage 66 through a fuel feed passage or tube 72 carried substantially by the upper body 62 and through a variable fuel nozzle 74 to the injector fuel-and-air mixing passage 66. Fuel is also supplied to the engine air flow or primary air intake passage 50 through a fuel bleed passage 76 and only during high speed or wide open throttle conditions to lubricate moving parts and bearings located within the crankcase 28. Fuel is supplied from a tank (not shown) to the fuel metering assembly 70, when the engine is operating, by a fuel pump assembly 78.

As shown in FIG. 2, the fuel pump assembly 78 has a flexible diaphragm 80 received and sealed between a bottom face of the upper body 62 and an upper face of the intermediate body 60 and defining in part a fuel pump chamber 82 and a pulse chamber 84 to which vacuum and pressure pulses in the crankcase 28 of the two-cycle engine are introduced through a vacuum passage 86 to repeatedly flex or actuate the diaphragm 80. Flexing of the diaphragm 80 draws fuel from the fuel tank through a fuel inlet tube fitting 88, a one-way check valve and interconnecting passages into the pump chamber 82 and supplies fuel under pressure from the pump chamber through a check valve and outlet passage 90 to the fuel metering assembly 70.

The fuel metering assembly 70 has a flexible diaphragm 92 received and sealed between a lower face of the intermediate body 60 and an upward facing peripheral portion of the bottom cover 64 to define a fuel metering chamber 94 directly above the diaphragm and an atmospheric air chamber 96 directly below or on the other side of the diaphragm which communicates with the atmosphere exteriorly of the carburetor through a port 98 in the bottom cover 64. The flow of fuel from the pump 78 into the fuel chamber 94 is controlled by a flow valve 100 with a seat 102 engageable by a complementary valve head 104. The flow valve 100 is opened and closed to control the admission of fuel into the chamber 94 by movement of the diaphragm 92 which is operably connected to the valve head 104 by a lever 106 which is connected adjacent one end to the valve head, adjacent the other end bears on a button 108 attached to the center of the diaphragm and between its ends is pivotally mounted on a support shaft 110. The valve head 104 is yieldably biased to its closed position by a spring 109 bearing on the lever 106 and received in a pocket or circular groove in the fuel metering chamber 94 and carried by the intermediate body 60. In operation of the charge forming device 14, as fuel is drawn from the fuel metering chamber 94 and supplied to the operating engine, the diaphragm 92 is displaced to open and close the flow valve 100 to replenish the fuel in the metering chamber and to maintain the fuel in the chamber at a substantially constant pressure relative to the atmospheric pressure acting on the other side of the diaphragm.

The fuel bleed passage 76 extends from the fuel metering chamber 94 to a nozzle 101 opened to the inlet portion of the air intake passage 50. Only under wide open throttle conditions, when the intake vacuum pressure exerted upon the nozzle 101 is high, will the 50:1 fuel and oil mixture flow from the metering chamber 94 through passage 76 and nozzle 101, and into the air intake passage 50. The air intake passage 50 will then carry the lubricating fuel mixture into the crankcase 28 for lubrication of moving parts during high speed running conditions of the engine 16. During engine idle conditions, because the vacuum pressure exerted upon the nozzle 101 is consequently low, the fuel from the metering chamber 94 will hardly flow through the nozzle 101 via the fuel bleed passage 76. However, lubrication of the idling engine 16 will not be adversely affected because the lubricating oil contained in the fuel supplied to the crankcase via the fuel mixing passage 66 is sufficient to lubricate the engine under idle conditions.

During engine operation, the amount of air flow through the air intake passage 50 is controlled by a rotary throttle valve 111 having an elongated cylindrical rotary member 112 which traverses the air intake passage 50 and is seated rotatably and vertically or axially movably within a substantially vertical cylindrical valve chamber 114 of the valve 111 communicating through a top surface 116 of the upper body 62. A throttle bore 118 laterally extends through the rotary member 112 providing adjustable communication between the upstream end or inlet port 120 adjacent an air cleaner (not shown) and downstream end or outlet port 122 of the air intake passage 50.

Rotation of the rotary throttle 112 causes the throttle bore 118 of the rotary member 112 to align or mis-align longitudinally with the air intake passage 50, and the rotary member 112 to rise or fall axially within the valve chamber 114. Providing the rotation means is a throttle shaft 124 which projects concentrically upward from the rotary member 112, extending out of the valve chamber 114 and through a plastic lid 126 engaged to the top surface 116 of the upper body 62. A throttle valve lever (not shown) projects laterally outward from the valve shaft 124 and a cam follower (not shown) projects upward from the lid 126 and is in slidable engagement with a cam groove, which is circular and gradually shallower in depth, formed in the lower surface of the throttle valve lever to constitute a cam mechanism. A return spring (not shown) loosely wound about the valve shaft 124 has one end fastened on the rotary throttle valve 111 and the other end fastened on the lid 126. The rotary throttle valve 111 is rotated and biased to an idle position by the return spring and cam mechanism.

Fuel in the fuel metering chamber 94 is supplied to the fuel mixing passage 66 via a check valve 128, a fuel jet 130 and the fuel nozzle 74 which communicates laterally through the fuel feed tube 72 within the fuel-and-air mixing passage 66. The tube 72 extends substantially perpendicularly through the fuel-and-air mixing passage 66, is concentric to the rotational axis of the rotary member 112, and is rigidly engaged to the upper body 62. The upper portion of the fuel feed tube 72 is fitted into a cylindrical pocket 132 carried by the upper body 62, and is sealed to the upper body 62 via an O-ring 134 disposed within the pocket 132 to avoid a tendency toward equalization of pressure between the air intake passage 50 and the fuel mixing passage 66. A needle 136 of the rotary throttle valve 111 is disposed partially within the tube 72 and adjusts the opening degree of the nozzle 74 and therefore fuel flow. The needle 136 projects rigidly downward from and concentrically to the rotary member 112 of the rotary throttle valve 111 and transversely adjustably into the fuel nozzle 74. As the rotary member 112 rotates and moves vertically within the valve chamber 114 via the cam mechanism, the needle 136 moves vertically into and out of the nozzle 74 within the tube 72.

Idle speed and richness of the fuel and air mixture can be adjusted via the needle 136 which has an upper end 138 capable of receiving a screwdriver and is engaged threadably and adjustably within a threaded bore 140 disposed concentrically within the valve shaft 124. A guideway 142 for the needle 136 communicates from the threaded bore 138, transversely through the throttle bore 118 of the rotary member 112, and to the cylindrical pocket 32, and is disposed concentrically about the rotational axis of the rotary throttle valve 111. The needle 136 thus projects downward from the shaft 124 transversely through the throttle bore 118 and into the nozzle 74. Rotational adjustment at the upper end 138 of the needle 136 will move the needle axially into or out of the nozzle for leaner or richer engine operation. An O-ring 144 compressed between the needle 136 and the rotary member 112 and seated within the guideway 142 between the threaded bore 140 and the throttle bore 118 prevents vacuum loss along the guideway to atmosphere. The O-ring 134 is also compressed radially between the needle 136 and the upper body 62 to prevent fuel loss from the feed tube 72 into the air intake passage 50.

Engine Operation

In operation, the crankcase 28 is under sub-atmospheric pressure when piston 18 moves upward during its compression stroke. Prior to reaching a top dead center (TDC) position, the crankcase port 58 is unveiled by the piston skirt 56 exposing the lower end of the tuned injector tube 12 to the sub-atmospheric pressure of the crankcase 28. With the tuned injector tube 12 under sub-atmospheric pressure, the connecting tube 68 operates to allow a rich mixture of fuel-and-air to flow from the fuel mixing passage 66 and into the upper portion of the tuned injector tube 12 near the cylinder intake port 48.

As the piston 18 reaches the TDC, the compressed fuel and air mixture within the combustion chamber 34 is ignited by the spark plug 32. The expansion of the ignited gases forces the piston 18 to move downward toward BDC. During this downward stroke, the engine 16 is delivering power through the rod 22 and throw 24, to rotate the crankshaft 26 and the crankcase 28 becomes pressurized. The tuned injector tube 12 becomes pressurized because it is still exposed to the pressurized crankcase 28 through the crankcase port 58.

As the piston 18 continues its downward stroke and closes the crankcase port 58 and hence the lower end of the tuned injector tube 12 from the crankcase 28, the previously inducted charge of the rich fuel-and-air mixture is substantially left resident in the tube. The exhaust port 36 near BDC opens and exhaust gases begin to escape through the exhaust pipe 38. Soon after opening of the exhaust port 36, and preferably immediately before scavenging or cylinder port 44 is uncovered by the piston 18 and fresh air begins to enter the chamber 34, the intake port 48 is uncovered by the piston 18 and the expansion pressure of combustion gases in the cylinder 20 generates a pressure pulse wave which is introduced into and travels down the tuned injector tube 12, and is reflected back toward the still open intake port 48 to provide a reflected pneumatic pressure pulse which carries the previously induced charge of the rich fuel-and-air mixture from the tuned injector tube 12 into the combustion chamber 34 (which is near atmospheric pressure due to the exhaust port 36 being recently opened) through the open intake port 48.

Also on the downward stroke of the piston 18, and depending upon the engine application, the fuel-and-air mixture is substantially left resident in the upper portion of the tuned injector tube 12, but the heavier ends or oil portion of the fuel mixture is substantially left resident in the lower portion of the tube.

On the return stroke of piston 18 as it moves toward TDC, the piston covers and closes the injector intake port 48, compresses the fuel-and-air mixture in the combustion chamber 34 for the next combustion event, and opens the crankcase port 58 for communication of the lower end of the tuned injector tube 12 with the sub-atmospheric crankcase pressure to repeat the fuel induction and subsequent injection cycle. The tuned injector tube 12 is of sufficient length and diameter that the fuel-and-air mixture charge inducted in the upper portion of the tube 12 at high engine speeds does not flow into the engine crankcase 28 while port 58 is open. However, at idle and low engine speeds, heavier ends or oils of the fuel mixture left resident in the lower portion of the tube 12 adjacent to port 58, and from previous cycles, will expel through port 58 providing lubrication for the reciprocating engine components within the crankcase.

As noted briefly above, after the combustion event and as the piston 18 moves toward BDC and after opening the exhaust port 36, the piston 18 also opens the cylinder port 44 to transfer compressed air from the crankcase 28 into the cylinder 20 to scavenge and aid in removing exhaust gasses, provide fresh air for the subsequent combustion event, and to remain in the combustion chamber 34 and preferably provide stoichiometric dispersion of the rich fuel-and-air mixture discharged from the open intake port 48.

After passing through BDC, as piston 18 returns toward TDC, and after closing the intake port 48 (and usually cylinder port 44 and exhaust port 36), the skirt 56 of the piston 18 also opens the air intake cylinder port 54 to draw fresh air through the air intake passage 50 of the charge forming device 14 into the crankcase. After the combustion event, as the piston moves from TDC toward BDC, the air intake cylinder port 54 is closed and the compressed air in the crankcase is transferred into the combustion chamber 34 through the scavenging ports 40, 44.

While the forms of the invention herein disclosed constitute a presently preferred embodiment, many others are possible. It is not intended herein to mention all the equivalent forms or ramifications of the invention. It is understood that the terms used herein are merely descriptive, rather than limiting, and that various changes may be made without departing from the spirit or scope of the invention as defined by the following claims.

I claim:

1. A fuel injection system for a two-stroke spark ignited internal combustion engine having a cylinder, a piston received for reciprocation in the cylinder, a crankshaft driven to rotate by the piston, a crankcase communicating with the piston and in which the crankshaft is received, a primary air intake port communicating with the crankcase, a transfer passage communicating with the crankcase and having a transfer port communicating with the cylinder, an exhaust port communicating with the cylinder, and an engine intake port communicating directly with the cylinder, the fuel injection system comprising:

a body;

a primary air intake passage in the body and having an inlet port communicating with atmosphere and an outlet port constructed and arranged to communicate with the primary air intake port of the engine;

a separate fuel-and-air mixing passage in the body and having an inlet communicating with the atmosphere and an outlet constructed and arranged to communicate with the engine intake port;

a rotary throttle valve having a valve chamber, a cylindrical rotary member, and a needle, the valve chamber carried by the body and communicating transversely through the air intake passage, the rotary member disposed rotatably and vertically movably within the valve chamber, the rotary member having a throttle bore communicating laterally through the member, the throttle bore being aligned to the air intake passage when the rotary throttle valve is rotated to a wide open throttle position and partially mis-aligned to the air intake passage when the rotary throttle valve is rotated to an idle position, wherein the needle projects concentrically from the rotary member;

a fuel metering assembly carried by the body and having a fuel metering chamber at a substantially constant pressure;

a fuel feed tube defining a fuel feed passage communicating between the metering chamber and the fuel-and-air mixing passage for supplying a majority of fuel flow of a rich fuel-and-air mixture to the cylinder through the engine intake port; and a fuel nozzle carried by the fuel feed tube and communicating with the fuel-and-air mixing passage, the needle of the rotary throttle valve extending axially into the fuel feed passage, wherein the needle is constructed and arranged to move axially into and out of the nozzle in response to rotation of the throttle valve to vary the degree of opening of the nozzle and thus fuel flow entering the fuel-and-air mixing passage from the metering chamber.

2. The fuel injection system set forth in claim 1 which also comprises a fuel bleed passage communicating between the fuel metering chamber and the air intake passage.

3. The fuel injection system set forth in claim 2 wherein the fuel bleed passage communicates with a bleed nozzle disposed in the air intake passage between the inlet port and the throttle bore of the rotary throttle valve, the bleed nozzle being sized to flow a minority of fuel into the air intake passage from the metering chamber during high engine speed conditions for engine lubrication and hardly any fuel during engine idle conditions.

4. The fuel injection system set forth in claim 3 comprising:

a tuned injector tube communicating with the combustion chamber through the intake port when the piston is near BDC and with a crankcase port communicating with the crankcase when the piston is near TDC; and a connecting tube communicating the fuel-and-air mixing passage with the tuned tube near the intake port.

5. The fuel injection system set forth in claim 4 which also comprises a fuel pump carried by the body and actuated by pressure variations produced by the operating engine to supply fuel to the fuel chamber.

6. The fuel injection system set forth in claim 5 wherein the rotary throttle valve has a shaft projecting rigidly and concentrically from the rotary throttle valve in an opposite direction than the needle and through a lid engaged to the body.

7. The fuel injection system set forth in claim 6 wherein the shaft is hollow and contains a threaded bore and wherein the needle has a threaded upper end engaged threadably to the shaft within the threaded bore.

8. The fuel injection system set forth in claim 7 wherein the rotary throttle valve has a guideway communicating concentrically from the threaded bore, through the rotary member, and to the fuel feed passage, and the needle extends through the guideway.

9. The fuel injection system set forth in claim 8 comprising:

an upper body of the section carrying the air intake passage, the air and fuel mixture passage, the rotary throttle valve chamber, and the fuel feed passage;

a separate intermediate section of the body engaged to the upper section from below, the fuel pump defined between the upper and intermediate sections; and a bottom plate of the body, the intermediate section being engaged between the upper section and the bottom plate, and wherein the fuel metering assembly is carried between the intermediate section and the bottom plate.

10. A fuel injection system for a two-stroke spark ignited internal combustion engine having a cylinder, a piston received for reciprocation in the cylinder, a crankshaft driven to rotate by the piston, a crankcase communicating with the piston and in which the crankshaft is received, a primary air intake port communicating with the crankcase, a transfer passage communicating with the crankcase and having a transfer port communicating with the cylinder, and an exhaust port communicating with the cylinder, the fuel injection system comprising:

a tuned injector tube extending between an engine intake port communicating directly with the cylinder and a crankcase port communicating with the crankcase;

a connecting tube communicating with the tuned injector tube near the engine intake port; and a charge forming device having:

a body, a primary air intake passage in the body and having an inlet communicating with atmosphere and an outlet constructed and arranged to communicate with the primary air intake port of the engine, a separate fuel-and-air mixing passage in the upper body and having an inlet communicating with the atmosphere and an outlet constructed and arranged to communicate with the connecting tube, a rotary throttle valve having a valve chamber, a cylindrical rotary member, and a needle, the valve chamber carried by the body and communicating transversely through the air intake passage, the rotary member disposed rotatably and vertically movably within the valve chamber, the rotary member having a throttle bore communicating laterally through the member, the throttle bore being aligned to the air intake passage when the rotary throttle valve is rotated to a wide open throttle position and partially mis-aligned to the air intake passage when the rotary throttle valve is rotated to an idle position, wherein the needle projects concentrically from the rotary member, a fuel metering assembly carried by the body and having a fuel metering chamber at a substantially constant pressure, a fuel feed tube defining a fuel feed passage communicating between the metering chamber and the fuel-and-air mixing passage for supplying a majority of fuel flow of a rich fuel-and-air mixture to the cylinder through the engine intake port; and a fuel nozzle carried by the fuel feed tube and communicating with the fuel-and-air mixing passage, the needle of the rotary throttle valve extending axially into the fuel feed passage, wherein the needle is constructed and arranged to move axially into and out of the nozzle to vary the degree of opening of the nozzle and thus fuel flow entering the fuel-and-air mixing passage from the metering chamber.

11. The fuel injection system set forth in claim 10 wherein a fuel bleed passage of the charge forming device communicates between the air intake passage and the fuel metering chamber.

12. The fuel injection system set forth in claim 11 wherein the fuel bleed passage has a bleed nozzle disposed in the air intake passage between its inlet and the throttle bore of the rotary throttle valve, the nozzle being constructed and arranged to flow a minority of fuel during high engine speed conditions and hardly any fuel during engine idle conditions.

* * * * *